United States Patent [19]

Walsh

[11] Patent Number: 4,792,716

[45] Date of Patent: Dec. 20, 1988

[54] ENERGY-EFFICIENT ELECTRIC DISCHARGE LAMP WITH REFLECTIVE COATING

[75] Inventor: Peter Walsh, Stirling, N.J.

[73] Assignee: Duro-Test Corporation, North Bergen, N.J.

[21] Appl. No.: 316,228

[22] Filed: Oct. 29, 1981

[51] Int. Cl.[4] ..... H01J 5/16; H01J 61/40; H01K 1/26; H01K 1/30

[52] U.S. Cl. ..... 313/113; 313/635

[58] Field of Search ..... 313/113, 635

[56] References Cited

U.S. PATENT DOCUMENTS 4,006,378 2/1977 Silverstein et al. ..... 313/635

4,308,186 12/1981 Schreurs et al. ..... 313/635

4,375,605 3/1983 Fontana et al. ..... 313/635

*Primary Examiner*—William L. Sikes

*Assistant Examiner*—Robert E. Wise

*Attorney, Agent, or Firm*—Darby & Darby

[57] ABSTRACT

A high-pressure mercury vapor lamp uses an envelope with an elliptical region which is coated on its interior surface. The coating reflects energy in the violet and passes energy in the green and yellow-green. By suppressing electron transitions which yield violet radiation, transitions which yield green and yellow-green radiation are enhanced, increasing lumen output by redistributing energy to more luminous lines in the line spectrum of mercury vapor plasma.

10 Claims, 4 Drawing Sheets

ENERGY-EFFICIENT ELECTRIC DISCHARGE LAMP WITH REFLECTIVE COATING

This invention pertains to electric lamps, and more particularly pertains to high intensity discharge lamps (HID lamps) in which an ionizable medium such as mercury at high pressure is ionized between two electrodes in order to produce a plasma from which visible light is emitted.

It is known to provide a coating inside the envelope of an incandescent lamp in order to reflect infrared radiation back to the filament while permitting visible radiation to exit from the envelope. For example, U.S. Pat. No. 4,160,929 discloses an incandescent lamp in which a three-layer coating reflects infrared radiation back to the filament. This increases efficiency since less energy is required to heat the filament to the same temperature, while a large portion of the energy in the visible part of the spectrum is permitted to leave the lamp. Similarly, U.S. Pat. No. 4,048,347 discloses a nine-layer coating deposited inside the envelope of a cylindrical incandescent lamp, directed toward achieving the same result.

However, in the art of HID lamps, wherein a medium such as a single metal or a mixture of metals at high pressure is ionized to form a plasma within an arc tube, the luminous output of the lamp is not as dependent upon the temperature of the plasma as it is upon the optical characteristics of the plasma itself. More particularly, an HID lamp which ionizes a high pressure vapor to form a plasma has an output which is highly concentrated at various wavelengths, or lines, in the electromagnetic spectrum and is otherwise low. Some of these lines, those to which the human eye is highly responsive, are highly luminous, as in the case of green and yellow-green lines, while others, such as violet lines, are not.

Accordingly, the present invention is directed to an HID lamp in which an arrangement is provided to enhance the production of certain of the lines in the energy spectrum produced by the plasma so as to increase the luminous efficiency of the lamp. In the preferred embodiment of the invention, this is accomplished by providing a reflecting means in the form of a coating which is placed on the outer envelope of the lamp in which the arc tube is located. The coating is placed on a region of the outer envelope which is optically shaped so as to reflect radiation back to the plasma. The characteristics of the coating and the envelope's optically shaped region are such as to reflect back to the plasma one or more selected lines in the plasma energy spectrum which are not in the more useful portion of the visible range and to permit visible range energy to pass through. The portions of the spectrum which are reflected back to the plasma are chosen to suppress electron transitions between certain energy levels of the spectrum which produce energy at less useful wavelengths and to enhance transitions which take place between other more useful energy levels to produce visible light output.

It is therefore an object of the invention to provide a high intensity discharge lamp with increased luminous efficiency. ency.

Another object is to provide an HID lamp in which the luminous efficiency of the plasma discharge is enhanced by suppressing electron transitions between certain energy levels in the plasma spectrum and enhancing others.

An additional object is to provide a HID lamp having a means for reflecting back to the plasma discharge energy at certain wavelengths to enhance electron transitions which produce energy in the more luminous portion of the visible range.

Others objects and advantages of the present invention will become more apparent upon reference to the following specification and annexed drawings in which:

DETAILED DESCRIPTION OF PREFERRED EMBODIMENTS

Figure 3:
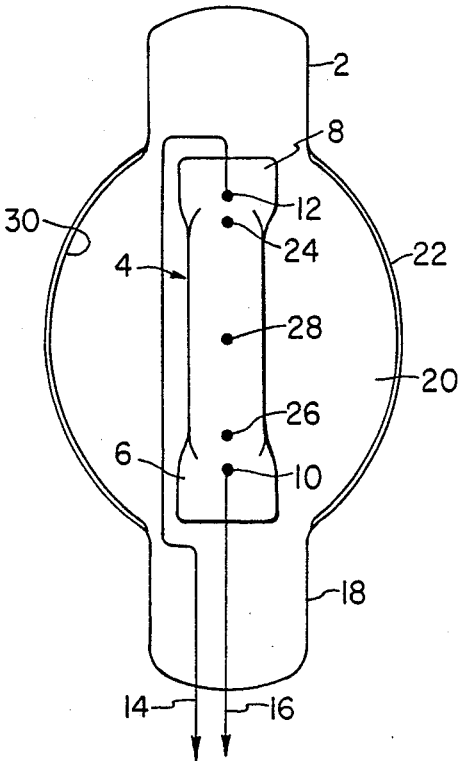
FIG. 3 is a schematic view of a high intensity discharge lamp in accordance with the invention.

The invention is illustratively described as pertaining to a high-pressure mercury vapor lamp although it can be used with lamps having other types of discharge media. In FIG. 3, a sealed hollow arc tube generally indicated by reference numeral 2 has a tubular central section 4 and flattened ends 6 and 8. The central section 4 of tube 2 contains aniionized medium, for example, a high-pressure mercury vapor.

Electrodes 10 and 12 are sealed at the ends 6 and 8 respectively of the arc tube. Leads 14 and 16 are connected to electrodes 10 and 12 to permit a voltage to be placed across electrodes 10 and 12 and to thereby ionize the mercury vapor to form a plasma.

An envelope 18 of a suitable material, such as glass or PYREX, surrounds arc tube 2. Leads 14 and 16 are attached to a suitable conventional terminal (not shown) on the envelope 18 to permit their connection to an outside voltage source (not shown). It will be understood that leads 14 and 16 can terminate at suitable connectors anywhere on envelope 18. The particular arrangement of leads shown in FIG. 3 forms no part of the invention.

Envelope 18 is sealed and its interior 20 between arc tube 2 and the inner surface of envelope 18 may either be evacuated or filled with an inert gas. Envelope 18 is formed with an optically shaped region, here illustratively shown as being an elliptical region 22. Elliptical region 22 is shaped to have two foci 24 and 26 which are located within arc tube 2 between its center 28 and electrodes 10 and 12, on its longitudinal axis, and situated near the locations where the plasma is produced at the electrodes.

A coating 30 (which may be of different types discussed below) is located on envelope 18, at least over region 22. Coating 30 is shown on the inner surface of elliptical region 22 to prevent damage thereto arising from handling and outside contamination, but coating 30 may also be located on the outer surface of the envelope. The coating can also be located elsewhere on the envelope although it is then less useful.

Coating 30 reflects energy at less luminous wavelengths back to the plasma within arc tube 2 while transmitting energy at more luminous wavelengths out of the lamp. It is known from optics that, because region 22 is an ellipse as described earlier, energy emitted from the plasma anywhere along the length of arc tube 2 will be substantially reflected back to the plasma, regardless of the location along arc tube 2 from which the energy originates. The shape of elliptical region 22 is largely determined by the shape of arc tube 2 and the plasma. Generally, the reflection back to the arc tube should be at those locations at which the plasma is produced. Were arc tube 2 to be replaced by, e.g., a sphere, elliptical region 22 would advantageously be spherical. Other geometric shapes, such as cylinders, can also be used.

Figure 1:
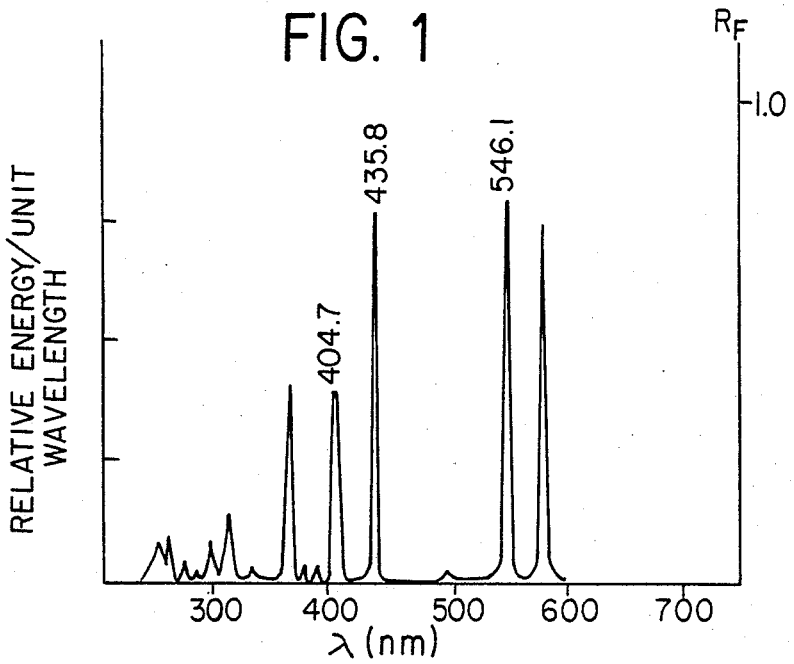
FIG. 1 shows the line spectrum output of a highpressure mercury vapor lamp in the near-ultraviolet and visible ranges.

FIG. 1 shows that the energy output of a high-pressure mercury vapor lamp is concentrated at certain wavelengths (or lines) in the electromagnetic spectrum. These lines include 404.7 nanometers, 435.8 nanometers add 546.1 nanometers. The output of a mercury vapor plasma at 404.7 and 435.8 nanometers has little lumen value since these two lines are in the violet. However, the 546.1 nanometer line is a highly luminous bright green or yellow-green. It would obviously be advantageous to suppress lines at 404.7 and 435.8 nanometers, if such suppression could result in an enhancement of the 546.1 nanometer line.

Figure 2:
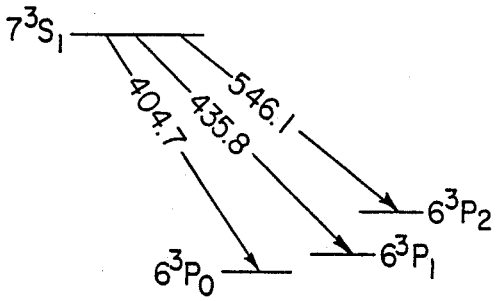
FIG. 2 is a diagram illustrating transitions of electrons between energy levels in the plasma which created the line spectrum of FIG. 1.

FIG. 2 shows that light output at these three wavelengths is a result of three different electron transitions between energy levels within the mercury vapor plasma. In such transitions, an electron leaves a higher energy level and enters a lower energy level, voiding the difference in energy as a photon, i.e. as a unit of radiation with a wavelength which here can be 404.7, 435.8, or 546.1nanometers. All three transitions share a common upper energy level, namely the $7^3S_1$ level, but the lower levels for these transitions are different. The transition which generates a photon at 404.7nanometers takes place between the $7^3S_1$ and the $6^3P_0$ levels, the transition which gnnerates a photon at 435.8nanometers takes place between the $7^3S_1$ and the $6^3P_1$ levels, and the transition which generates a photon at 546.1nanometers takes place between the $7^3S_1$ and $6^3P_2$ levels. As shown in FIG. 2, the $6^3P_0$ level is lower than the $6^3P_1$ level, which in turn is lower than the $6^3P_2$ level. Hence, the photon with the shortest wavelength is associated with the greatest loss of electron energy, and increasing wavelengths result from electron transitions of lesser decrease in energy.

It is known from quantum physics that electron transitions from the common $7^3S_1$ upper energy level in a mercury plasma to lower levels other than those listed above will take place only very rarely. It follows that increasing the population of electrons at the $7^3S_1$ level by suppressing electron transitions to the $6^3P_0$ levels will enhance electron transitions to the $6^3P_2$. This will have the effect of producing more luminosity with the same energy input, since transitions which produce less useful violet lines will be suppressed in favor of those producing more useful lines in the green and yellow-green.

Figure 4:
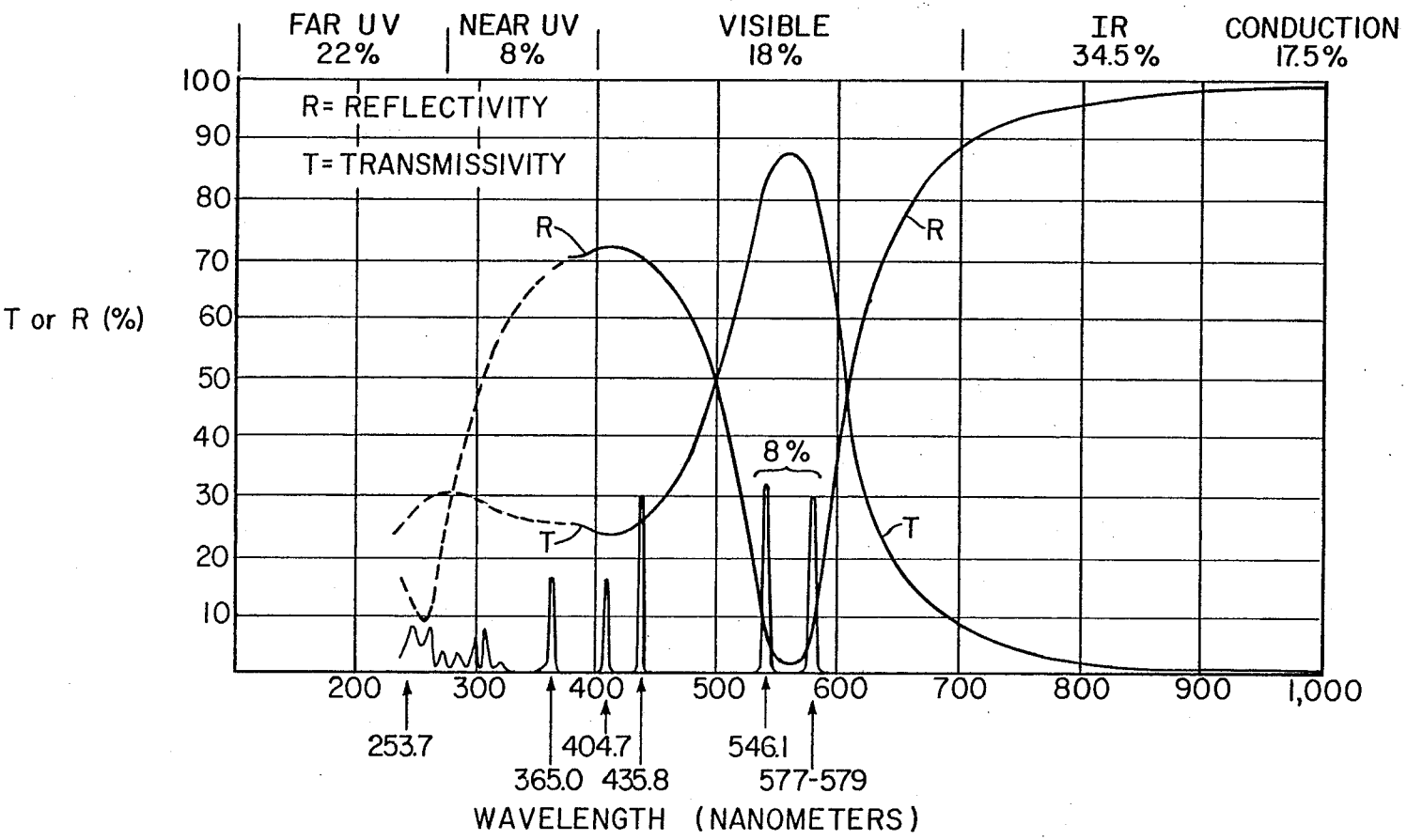
FIG. 4 is a graph of the reflectivity and transmissivity characteristics of one type of coating, superposed on a typical plasma energy spectrum.

In this example, coating 30 will reflect energy at the 404.7 and 435.8 nanometer lines back to the arc tube 2 and the plasma. Since strongly radiating transitions are also strongly absorbing transitions, energy at these lines will be strongly reabsorbed by the plasma. This will increase the electron population at the common $7^3S_1$ upper energy level and will enhance electron transitions which produce energy at the 546.1 nanometer line. FIG. 4 shows the reflectivity R and the transmissivity T of one presently preferred coating 30 which can be used in the invention. In this example, the coating is a three-layer etalon coating, i.e. a coating formed by two outer layers of a highly reflective metal with a dielectric medium layer between them. In the example under consideration, the innermost layer of the coating closest to the arc tube is a layer of silver which is about 15.9 nanometers thick. The central layer of the coating is a layer of manesium fluoride which is about 138 nanometers thick. The outermost layer of the coating furthest from the arc tube is a layer of silver which is about 18.5 nanometers thick.

Because silver has a high metallic index of refraction (which is mathematically complex), and magnesium fluoride has a low index of refraction of about 1.38, the coating 30 serves as a filter which reflects radiation at certain wavelengths from the boundaries between adjacent layers. As can be seen in FIG. 4, the coating in this example has a very low reflectivity and a very high transmissivity at the 546.1 and 577-579 nanometer lines. Similarly, the coating has a high reflectivity and a low transmissivity at the 404.7 and 435.8 nanometer lines. Thus, the coating will reflect most of the energy in the violet back to the plasma, and will transmit most of the energy in the green and yellow-green out of the lamp. It is possible to substitute gold, aluminum, and copper of suitable thickness for the layers of silver.

While the etalon coating just described is presently perferred, other optical coatings can be used. In general, such coatings are designed such that their maximum transmission is in the luminous portions of the visible and their reflectivity is high otherwise.

FIG. 4 also shows the spectral distribution of the output of a conventional 400 watt mercury vapor lamp. As is shown, about 22% of the output is in the far ultraviolet, 8% in the near ultraviolet, 18% in the visible, and 34.5% in the infrared. The remaining 17.5% is lost by heat conduction; a typical interelectrode distance in lamps of this type is 7 centimeters, and there is a heat conduction loss of about 10 watts/centimeter, which amounts to a total heat conduction loss of 70 watts or 17.5% of 400 watts.

TABLE 1

| | HEAT CONDUCTION $P_C$ (WATTS) | FAR UV $P_{FAR\ UV}$ (WATTS) | NEAR UV $P_{NEAR\ UV}$ (WATTS) | VISIBLE $P_{VIS}$ (WATTS) | IR $P_{IR}$ (WATTS) | TOTAL $P_T$ (WATTS) | LUMENS L | LUMENS/ WATT |
|---|---|---|---|---|---|---|---|---|
| CLEAR ENVELOPE | 70 | 87.5 | 32 | 72.1 | 138.4 | 400 | 20,500 | 51.2 |
| COATED | 70 | 87.5 | 10.9 | 72.1 | 27.1 | 267.6 | 24,600 | 91.9 |

TABLE 1-continued

| | HEAT CONDUCTION $P_C$ (WATTS) | FAR UV $P_{FAR\ UV}$ (WATTS) | NEAR UV $P_{NEAR\ UV}$ (WATTS) | VISIBLE $P_{VIS}$ (WATTS) | IR $P_{IR}$ (WATTS) | TOTAL $P_T$ (WATTS) | LUMENS L | LUMENS/ WATT |
|---|---|---|---|---|---|---|---|---|
| ENVELOPE | | | | | | | | |

ENERGY REQUIRED TO PRODUCE 24,600 LUMENS AT 51.2 LUMENS/WATT = 480 WATTS $$\text{ENERGY SAVINGS} = \frac{400\ \text{WATTS} - 267.6\ \text{WATTS}}{480\ \text{WATTS}} = 44\%$$

Table 1 summarizes the increase in efficiency of the invention using the above—described etalon coating as compared with the prior art. The invention can provide a 44% savings in energy over the prior art, resulting from(a) a reduction in the amount of energy lost in infrared radiation, (b) a reduction in the energy lost in the near-ultraviolet, and (c) an increase in the number of lumens produced by the lamp as a result of shifting the light output of the lamp from the violet towards the green. It should be noted that since the 404.7 and 435.8 nanometer lines are in the violet, the energy within the visible part of the spectrum remains substantially unchanged; it is the lumen output of this energy which increases as a result of the color shift.

Figure 5:
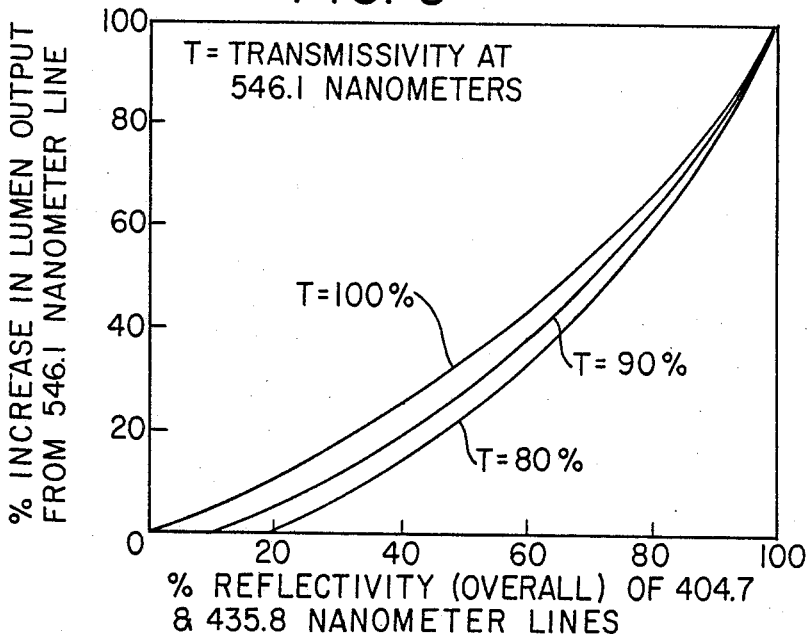
FIG. 5 is a graph showing the calculated increase of a line of the spectrum as a function of the reflectivity of the coating.

In FIG. 5, reflectivity at the 404.7 and 435.8 nanometer lines is assumed to vary. Thus, in FIG. 5, a 70% reflectivity in the violet such as that indicated in FIG. 4 will cause almost a 50% increase in lumen output at the 546.1 nanometer line, assuming a transmissivity of 87% for the 546.1 nanometer line, as is also shown in FIG. 4.

It is possible to design other coatings with more than three layers which will more closely approximate an ideal coating. For example, a multilayer, all dielectric coating having an odd number of layers may be used in which layers alternate with low index layers and high index layers are both closest to add furthest away from the arc tube. In general, such other coatings are designed such that their maximum transmission is in the visible, with a filter transmission width confined to the luminous portions of the visible, and the filter has high reflectivity in non-visible spectral regions which contain appreciable emission. By using a coating in which layers are made of a suitable thickness, e.g., of titanium dioxide (having an index of 2.2 as deposited) and in which the low index layers are made of a suitable thickness of, e.g., magnesium fluoride, a coating can be constructed which has essentially no absorption loss in the visible and near infrared. Therefore, the transmissivity T will equal 1−R where R is the reflectivity.

Figure 6:
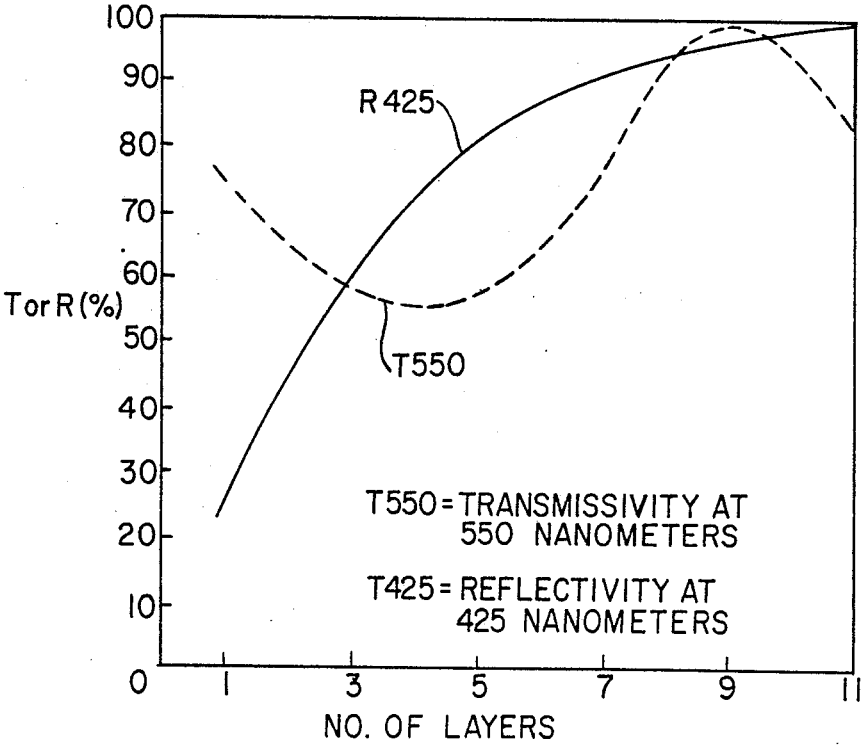
FIG. 6 is a graph showing the reflectivity and transmissivity of another type of coating as a function of the number of layers.

In a common multilayer filter coating of this type, each layer should have an optical thickness which is equal to one-fourth of the wavelength of the light to be reflected at its boundaries. An example of this second, all dielectric type of coating which is useful with media having the line spectrum of FIG. 1, uses titanium dioxide with a thickness of 47.8 nanometers and magnesium fluoride thickness of 75.1 nanometers. With these materials and thicknesses, it is possible to plot the reflectivity of the resulting coating at 425 nanometers (intermediate the 404.7 and 435.8 nanometer lines) and the transmissivity at 550 nanometers (intermediate the 546.1 and the 577–579 nanometer lines) as a function of the number of layers in the coating. In FIG. 6, it is assumed that the titanium dioxide layers will be closest to and furthest away from the arc tube, and that only an odd number of layers will be used.

As can be seen in FIG. 6, a nine-layer filter of this type has both an extremely high transmissivity at 550 nanometers and an extremely high reflectivity at 425 nanometers. Although the reflectivity at 425 nanometers of an eleven-layer filter is better than that of a nine-layer filter, the corresponding transmissivity of the eleven-layer filter at 550 nanometers is substantially reduced. Therefore, a filter of this type can advantageously have nine layers.

Figure 7:
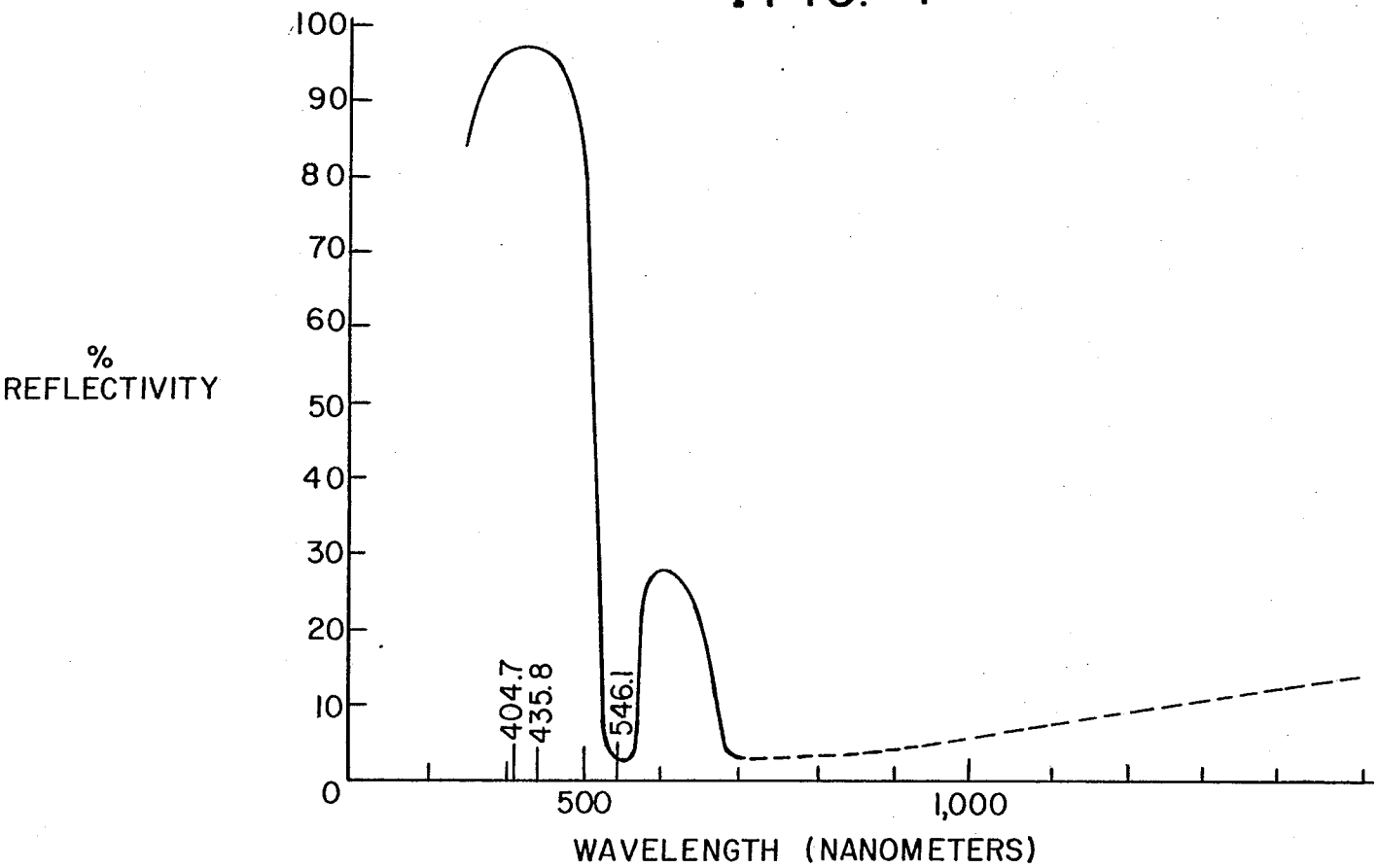
FIG. 7 illustrates the reflectivity of a nine-layer coating of the type illustrated in FIG. 6.

Turning now to FIG. 7, it is shown that the reflectivity of the coating in the violet portion of the spectrum is extremely high—approximately 97%. Moreover, the reflectivity at 550 nanometers is extremely low—less than 10%. (The ordinate of FIG. 7 is logarithmic). As stated above, absorption loss in the visible and near infrared is approximately zero.

TABLE 2

| | | | |
|---|---|---|---|
| LIGHT OUTPUT OF CLEAR ENVELOPE AT 546.1 NANOMETERS | = | 10,250 LUMENS | |
| LIGHT OUTPUT OF CLEAR ENVELOPE AT 577.579 NANOMETERS | = | 10,250 LUMENS | |
| | | 20,500 LUMENS | |
| REFLECTIVITY OF COATING OF FIG. 7 AT 435 NANOMETERS | = | 97% | |
| TRANSMISSIVITY OF COATING OF FIG. 7 AT 550 NANOMETERS | = | 99% | |
| INCREASE IN OUTPUT AT 546.1 NANOMETERS, PER FIG. 5 | = | 90% | |
| | = | ENHANCEMENT OF 1.9 | |
| LIGHT OUTPUT OF COATED ENVELOPE AT 546.1 NANOMETERS | = | 1.9 × 10,250 = .99 | = 19,280 LUMENS |
| LIGHT OUTPUT OF COATED ENVELOPE AT 577-79 NANOMETERS | = | 10,250 × .99 | = 10,147 LUMENS |
| | | | 29,427 LUMENS |
| LUMENS/WATT (COATED ENVELOPE) ≈73 | | | |
| LUMENS/WATT (CLEAR ENVELOPE) ≈51 | | | |
| ENERGY SAVINGS ≈30% | | | |

Table 2 summarizes the results of using the filter coating of FIG. 7. As can there be seen, the invention produces a substantially increased luminosity at an energy savings of approximately 30%.

Other materials can be substituted for titanium dioxide. Suitable alternatives include cryolite, zinc sulfide, indium oxide, indium tin oxide, and tin oxide.

It will be appreciated that the invention is not limited to use in high-pressure mercury vapor lamps, but can be used in other lamps that use an ionizable medium to produce a line spectrum.

What is claimed is:

1. An energy-efficient electric discharge lamp comprising:

means for producing a plasma volume of an ionizable medium, said plasma emitting electromagnetic energy distributed in a line spectrum and including energy at at least one more luminous lie and energy at at least one less luminous line, energy at said lines resulting form electron transitions that share a common upper energy level; and means adjacent said plasma volume producing means having thereon a coating formed by a plurality of layers of films having at least two different indices of refraction for selectively transmitting energy at said more luminous line from said plasma volume and for selectively reflecting spectral line energy at said less population at said common upper energy level and thereby enhance electron transitions producing energy at said more luminous line.

2. An energy-efficient electric discharge lamp comprising:

arc discharging means including an arc tube containing an ionizable medium for producing a plasma volume of an ionizable meidum, said plasma emitting electromagnetic energy distributed in a line spectrum and including energy at at least one more luminous line and energy at at least one less luminous line, energy at said lines resulting from electron transitions that share a common upper energy level; and an envelope surrounding the arc tube having a coating thereon for selectively transmitting energy at said more luminous line from said plasma volume and for selectively reflecting spectrial line energy at said less luminous line back to said plasma volume to increase electron population at said common upper energy level and thereby enhance electron transitions producing energy at said more luminous line, said coating having an odd number of layers, wherein layers having a low index of refraction are bounded on both sides by layer and an outermost layer of the coating have a high index of refraction.

3. The lamp of claim 2, wherein each layer is a dielectric.

4. The lamp of claim 3, wherein layers having a low index of refraction are layers of magnesium fluoride.

5. The lamp of claim 3, wherein layers having a low index of refraction are layers of magnesium fluoride, layers having a high index of refraction are layers of titanium dioxide, and there are 9 layers.

6. The lamp of by claim 2 wherein layers having a high index of refraction are selected from a group consisting of:

titanium dioxide;
indium oxide;
indium tin oxide;
tin oxide;
cryolite; and
zinc sulfide.

7. An energy-efficient electric discharge lamp comprising:

arc discharge means including an arc tube containing an ionizable medium for producing a plasma volume of an ionizable medium, said plasma emitting electromagnetic energy distributed in a line spectrum and including energy at at least one more luminous line and energy at at least one less luminous line, energy at said lines resulting from electron transitions that share a common upper energy level; and an envelope surrounding the arc tube having a coating thereon for selectively transmitting energy at said more luminous line from said plasma volume and for selectively reflecting spectral line energy at said less lumious line back to said plasma volume to increase electron population at said common upper energy level and thereby enchance electron transitions producing energy at said more luminous line, said coating having alternate layers of metal and dielectric material.

8. The lamp of claim 7, wherein the metal layers are selected from a group consisting of:

silver;
aluminum;
gold; and
copper.

9. The lamp of claim 7, wherein the coating has two outer metal layers and one inner dielectric layer.

10. The lamp of claim 7, wherein the coating has two outer dielectric layers and one inner metal layer.

* * * * *